United States Patent [19]

Cable

[11] 4,241,664

[45] Dec. 30, 1980

[54] FORMABLE DRIVE RAILS

[75] Inventor: Harold E. Cable, Thornburg Borough, Pa.

[73] Assignee: Weld Tooling Corporation, Pittsburgh, Pa.

[21] Appl. No.: 20,211

[22] Filed: Mar. 13, 1979

[51] Int. Cl.[3] ..... B61B 13/02; B61B 13/04

[52] U.S. Cl. ..... 104/118; 104/246; 105/29 R; 105/141; 238/1; 238/123

[58] Field of Search ..... 238/1, 10 R, 122, 123, 238/131; 104/118, 119, 120, 246, 247; 105/29 R, 141, 144, 145; 248/206 R, 206 A

[56] References Cited

U.S. PATENT DOCUMENTS

| | | | |
|---|---|---|---|
| 606,284 | 6/1898 | Grosvenor | 105/29 R X |
| 2,686,565 | 8/1954 | Gilbert et al. | 238/123 X |
| 2,706,696 | 4/1955 | Payson | 238/122 UX |
| 2,843,421 | 7/1958 | Shelton | 248/206 R X |
| 3,226,027 | 12/1965 | Cable et al. | 238/1 |
| 3,550,535 | 12/1970 | Rooklyn | 104/118 |
| 3,575,364 | 4/1971 | Frederick | 105/29 R X |
| 3,756,670 | 9/1973 | Harris | 105/29 R X |
| 4,092,928 | 6/1978 | Clavin | 104/119 |

*Primary Examiner*—Randolph A. Reese

*Attorney, Agent, or Firm*—Buell, Blenko, Ziesenheim & Beck

[57] ABSTRACT

An elongate formable drive rail for carrying a working apparatus having a toothed drive gear and support elements is provided in the form of a narrow elongate strip of metal having a regular series of corrugations extending lengthwise of the strip intermediate its edges and adapted to be engaged by the toothed drive gear while the edges of the strip engage the support elements.

8 Claims, 5 Drawing Figures

FORMABLE DRIVE RAILS

This invention relates to formable drive rails and particularly to a ribbon type drive rail which is highly flexible and will take the contour of a base upon which applied.

There are numerous devices used in the metal working industries which require the use of a guide and drive track following the contour of the work piece upon which work is being carried out.

Typical of such devices is the track or rail used to guide and hold a welding and/or cutting machine against a selected work surface. The surface may be in any position horizontal, vertical, overhead, at any angle, inside or outside a vessel, curved, straight, etc. Such situations are encountered in all areas of industry, e.g., in structural steel work, in machinery manufacture and repair, in ship building and ship repair, in containment vessels, tubing, conductors, etc. In some cases a rigid track or rail may be used but in many cases a flexible rail must be used and the degree of its flexibility, in many cases, determines the effectiveness and cost of the job. On ferrous metals the rail may be held on the work by means of holding magnets, which preferably are permanent plastic potted magnets. In those cases where the work is nonmagnetic, the rail can be held in place by means of vacuum cups of appropriate configuration or continuous vacuum cup compartments appropriately segmented to obtain maximum adherance and conformity with the surface to which the rail is engaged. Typical of the prior art devices for accomplishing this is illustrated in my earlier U.S. Pat. No. 3,226,027, issued Dec. 28, 1965.

I have developed a new track structure which is much more flexible, far more easily handled, stored and shipped than anything heretofore available. The rail configuration of this invention can be formed in ribbons of virtually any desired length and can be reeled or coiled for handling and shipment.

I provide an elongate formable drive rail for carrying a working apparatus having a toothed driving gear drivingly engaging said rail and support means engaging a portion of the edge of the side rail for supporting said apparatus, said formable drive rail comprising an elongate narrow strip of metal of width selected to carry said working apparatus, a regular series of corrugations formed in said strip extending lengthwise of said strip intermediate its edges, said corrugation corresponding substantially in shape and width along the median line of the strip to the tooth configuration of the toothed driving cog wheel or gear of said working apparatus and sloping outwardly therefrom to the plane of the strip along a line spaced from the edge of the strip to form a substantially uniform uncorrugated edge portion on each side of said corrugations receiving the support means for the working apparatus. Preferably, the drive rail is made of austentic stainless steel. Each edge of the strip is preferably folded under upon itself to provide a double thickness edge portion with a rounded edge face. Preferably, the rail is provided on one side with magnet holding means or vacuum means depending upon the use to which it is applied. Successive lengths of track are joined by junction bars, drilled and tapped for receiving holding screws. Preferably, the corrugations are in the form of a stub tooth involute gear rack configuration.

The corrugated rail configuration provides stiffness or rigidity in cross section, yet provides great flexibility over the length of the rail, coupled with light weight and easy handleability.

In the foregoing general description certain objects, purposes and advantages of this invention have been set out. Other objects, purposes and advantages of this invention will be apparent from a consideration of the following description and the accompanying drawings in which.

Figure 5:
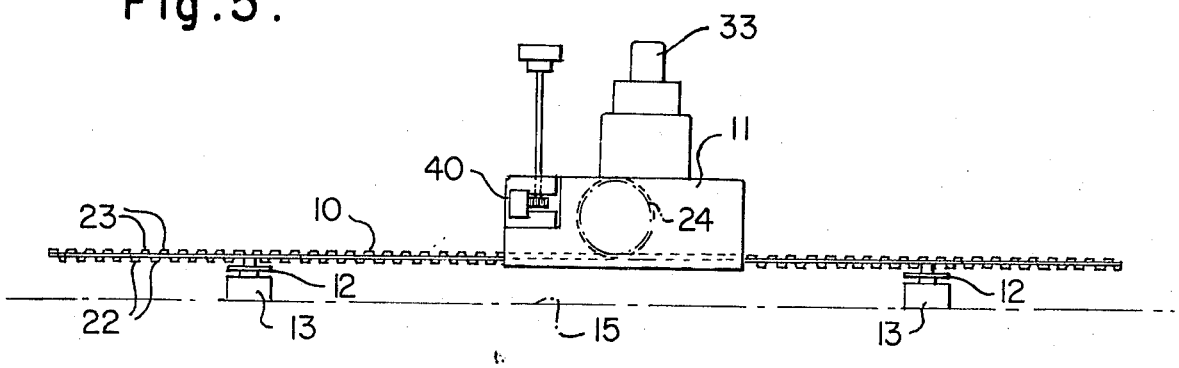
FIG. 5 is a side elevation of the track of FIG. 1 with a magnet holding means and travelling flame cutter/-welder assembly thereon.

Referring to the drawings a track or rail 10 made in accordance with this invention is illustrated in conjunction with a travelling flame cutting/welding machine 11. The track or rail 10 may be provided with longitudinally spaced transversely extending cross members 12 fixed to the underside thereof and carrying permanent magnets 13 positioned in spaced relation to the underside of the outer ends of the cross members 12. The flame cutting/welding machine 11 is a conforming powered machine engaging the rail 10 along which it is adapted to travel, e.g., on a steel work surface 15 against which track 10 is magnetically held as shown in FIG. 5. In those cases where the work is non-magnetic, vacuum cups are substituted for magnets 13.

Figure 1:
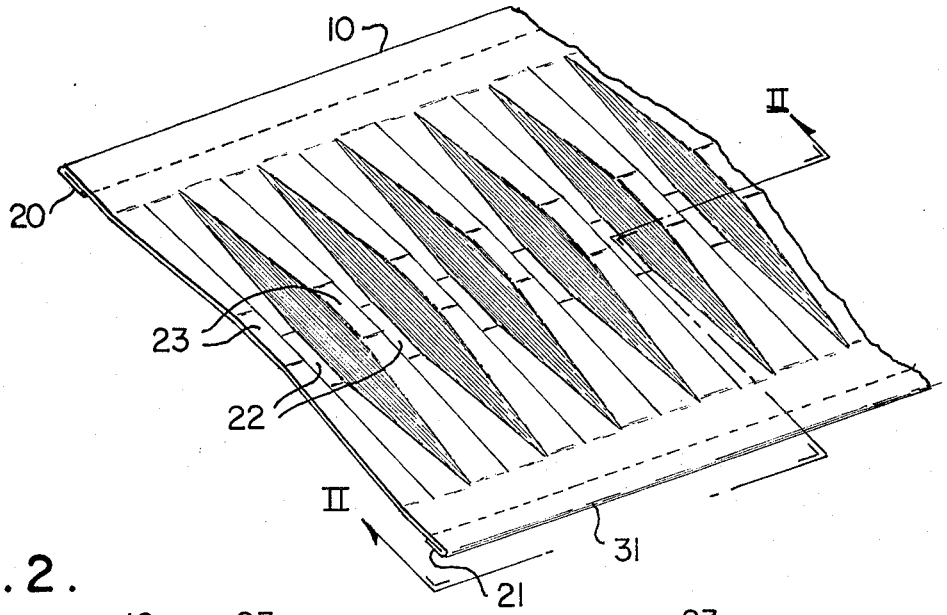
FIG. 1 is an isometric view of a track according to this invention utilized for a travelling flame cutting-/welding machine.
Figure 2:
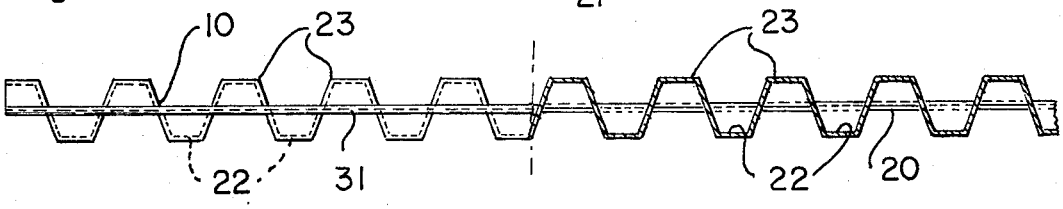
FIG. 2 is a side elevational view partly in section on line II—II of the embodiment of FIG. 1.
Figure 3:
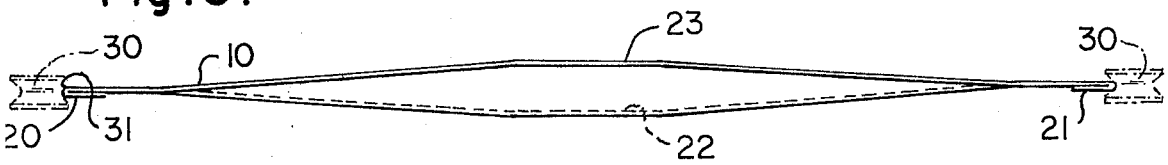
FIG. 3 is an end elevational view of the rail of FIG. 1.
Figure 4:
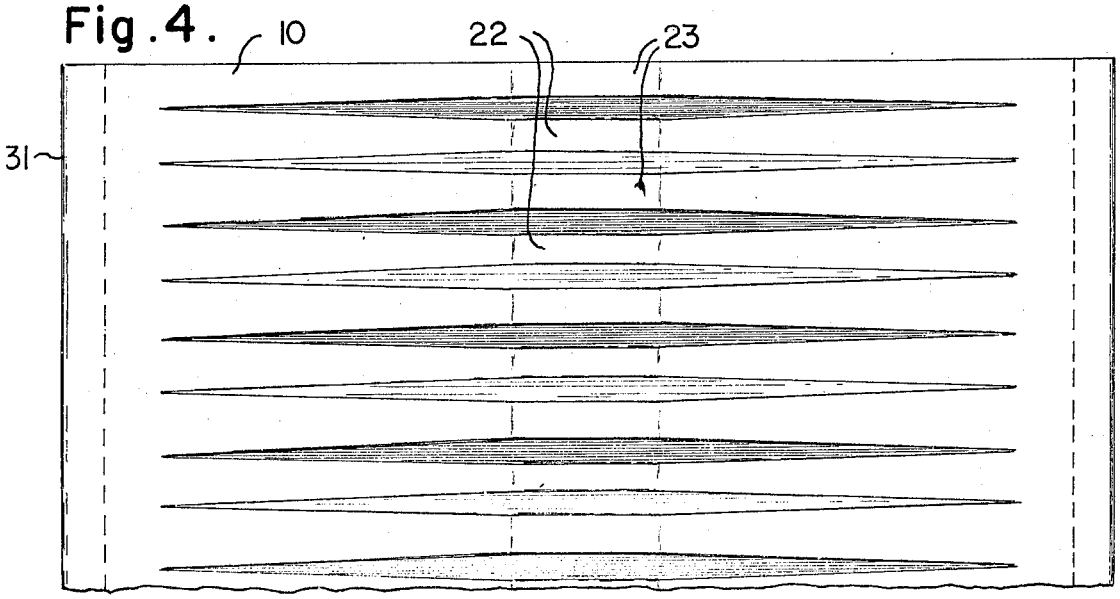
FIG. 4 is a top plan view of the track of FIG. 1.

The track or rail 10 comprises a band or ribbon of sheet metal with each side edges 20 and 21 folded under upon itself to form a narrow double thickness band. The center or median portion of the strip is corrugated with a series of successive corrugations 22 which taper from the folded edges to a center portion 23 having a width equal to that of drive gear 24 on flame cutting/welding machine 11 and a contour corresponding to the contour of the gear teeth, preferably stub tooth involute gear configuration as illustrated in FIG. 2.

The flame cutting/welding machine 11 has grooved beveled wheels 30 at each corner which engage the rounded edges 31 of rail 10 formed by bending each of side edges 20 and 21 upon itself. Thus, the machine is held on rail 10 regardless of the position of the track, i.e., horizontal, vertical, overhead, etc., with the drive gear 24 engaged in the median portion of corrugations 22 so that the machine is uniformly moved on the track by the drive gear and its motor 33 on machine 11. The motor 33 may be controlled from a source of electric power by electric wires, not shown, or by known electronic means, not shown. Machine 11 is provided with a torch holder 40 and torch (not shown) rigidly held thereby at a selected height and angle for cutting and-/or welding upon work surface 15 as machine 11 is moved along rail 10.

As shown, the rail 10 is highly flexible so that it can be bent about a transverse axis and it may also be twisted to accommodate compound curves.

While certain specific embodiments and practices of this invention have been illustrated and described in the foregoing specification, it will be understood that this invention may be otherwise embodied within the scope of the following claims.

I claim:

1. An elongate formable drive rail for carrying a working apparatus having a toothed driving gear drivingly engaging said rail and support means engaging a portion of the edge of the side rail for supporting said apparatus comprising an elongate narrow strip of metal of width selected to carry said working apparatus, having opposite faces and opposite side edges, a regular series of corrugations formed in said strip on both faces extending lengthwise of said strip intermediate its edges, said corrugations corresponding substantially in shape and width along the median line of the strip to the tooth configuration of the toothed driving gear of said working apparatus and sloping therefrom on each side to the plane of the strip to form a substantially smooth uncorrugated edge portion on each side of said corrugations receiving the support means for the working apparatus.

2. An elongate formable drive rail as claimed in claim 1 wherein the drive rail is made of austentic stainless steel.

3. An elongate formable drive rail as claimed in claim 2 wherein said corrugations at the median line of the strip are in the form of a stub tooth involute gear configuration.

4. An elongate formable drive rail as claimed in claim 1 wherein each side edge is folded upon itself in a plane parallel to said strip to form a double thickness portion of relatively narrow width.

5. An elongate formable drive rail as claimed in claim 4 wherein the folded double thickness portion provides a substantially semi-circular face.

6. An elongate formable drive rail as claimed in claim 1 wherein said rail has a plurality of spaced holding magnets on one side for engaging a ferromagnetic work piece.

7. An elongate formable drive rail as claimed in claim 1 wherein said rail has a plurality spaced vacuum cups on one side for engaging a work piece.

8. An elongate formable drive rail as claimed in claim 1 wherein said corrugations at the median line of the strip are in the form of a stub tooth involute gear configuration.

* * * * *